299-13 SR
4/3/79 XR 4,147,389

United States Patent [19] [11] 4,147,389
Bartel et al. [45] Apr. 3, 1979

[54] METHOD FOR ESTABLISHING A COMBUSTION ZONE IN AN IN SITU OIL SHALE RETORT

[75] Inventors: William J. Bartel, Grand Junction, Colo.; Chang Y. Cha, Bakersfield, Calif.; Robert S. Burton, III, Grand Junction, Colo.

[73] Assignee: Occidental Oil Shale, Inc., Grand Junction, Colo.

[21] Appl. No.: 810,491

[22] Filed: Jun. 27, 1977

Related U.S. Application Data

[63] Continuation-in-part of Ser. No. 770,860, Feb. 22, 1977, abandoned, which is a continuation of Ser. No. 492,767, Jul. 29, 1974, abandoned.

[51] Int. Cl.[2] ..... E21B 43/24; E21B 43/26
[52] U.S. Cl. ..... 299/2; 166/259; 299/13
[58] Field of Search ..... 166/247, 299, 256, 259, 166/257, 262; 299/2, 4, 13

[56] References Cited

U.S. PATENT DOCUMENTS

| | | | |
|---|---|---|---|
| 3,165,154 | 1/1965 | Santourian | 166/257 |
| 3,349,848 | 10/1967 | Burgh | 166/256 X |
| 3,417,818 | 12/1968 | Dyson | 166/262 |
| 3,454,958 | 7/1969 | Parker | 166/256 |
| 3,465,819 | 9/1969 | Dixon | 166/247 |
| 3,586,377 | 6/1971 | Ellington | 299/4 |

*Primary Examiner*—Stephen J. Novosad
*Attorney, Agent, or Firm*—Christie, Parker & Hale

[57] ABSTRACT

A method for retorting oil shale in an in situ oil shale retort includes the steps of excavating a void in a subterranean formation containing oil shale and placing combustible material in the void adjacent an ignition situs. Formation is then explosively expanded toward the void to form a retort containing a fragmented permeable mass of formation particles containing oil shale, the top layer of the fragmented mass adjacent an ignition situs containing such combustible material. The combustible material is then ignited for establishing a combustion zone in the retort.

39 Claims, 3 Drawing Figures

METHOD FOR ESTABLISHING A COMBUSTION ZONE IN AN IN SITU OIL SHALE RETORT

CROSS REFERENCES

Figure 1:
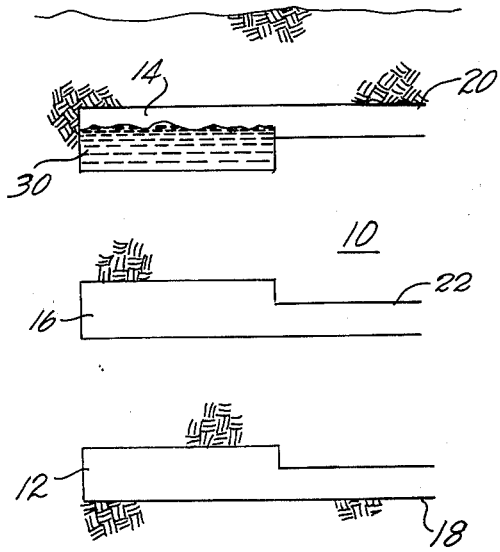

This application is a continuation-in-part of U.S. Pat. application Ser. No. 770,860 filed on Feb. 22, 1977, now abandoned which is a continuation of U.S. Patent application Ser. No. 492,767 filed on July 29, 1974, now abandoned. Each of these two patent applications is incorporated herein by this reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce liquid and gaseous hydrocarbon products. It is the formation containing kerogen that is called "oil shale" herein, and the liquid hydrocarbon product is called "shale oil". A number of methods have been proposed for processing oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing "retorted oil shale".

One method of supplying hot retorting gases used for converting kerogen contained in the oil shale, as described in U.S. Pat. No. 3,661,423, includes establishment of a combustion zone in the retort and introduction of any oxygen containing retort inlet mixture into the retort as a gaseous combustion zone feed to advance the combustion zone through the retort. In the combustion zone oxygen in the combustion zone feed is depleted by reaction with hot carbonaceous materials to product heat and combustion gas. By the continued introduction of the retort inlet mixture containing oxygen into the retort, the combustion zone is advanced through the fragmented mass.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products including gaseous and liquid hydrocarbon products and to a residue of solid carbonaceous material.

The liquid products and gaseous products are cooled by cooler particles in the fragmented mass in the retort on the advancing side of the retorting zone. The liquid hydrocarbon products, together with water produced in or added to the retort, are collected at the bottom of the retort. An off gas containing combustion gas generated in the combustion zone, gaseous products produced in the retorting zone, gas from carbonate decomposition, and the gaseous portion of retort inlet mixture that does not take part in the combustion process is withdrawn from the bottom of the retort.

Parker in U.S. Pat. No. 3,454,958 describes a method for producing oil from oil shale in a nuclear chimney having a void at the top by igniting shale in the top of the chimney to establish a combustion zone. Parker teaches that the combustion zone may be established by burning a bed of charcoal soaked in a suitable fuel placed in the void. Although the method of Parker can be used in a retort having a void at the top for placement of charcoal such as a retort produced by a nuclear explosive, it is useless for a retort which is filled with a fragmented permeable mass containing oil shale and thus has little or no void at the top.

Establishment of a combustion zone in the retort can be effected according to the method described in U.S. Patent application Ser. No. 578,203 filed May 16, 1975, and now U.S. Pat. No. 4,027,917 and 3,952,801 issued Apr. 27, 1976 to Robert S. Burton III, and assigned to the assignee of this application. Both this patent application and patent are incorporated herein by this reference. The patent to Burton describes a technique for establishing a combustion zone in a retort by igniting the top of a fragmented permeable mass in the retort. According to this technique, a hole is bored to the top of the fragmented permeable mass and a burner is lowered through the bore hole to the oil shale to be ignited. A mixture of a combustible fuel such as LPG (liquified petroleum gas) and gas containing oxygen, such as air, is burned in the burner and the resultant flame is directed downwardly towards the fragmented permeable mass. The burning is conducted until a substantial portion of the oil shale has been heated above its ignition temperature so combustion of oil shale in the fragmented mass is self-sustaining. Then introduction of fuel is terminated, the burner is withdrawn from the retort through the hole, and oxygen supplying gas is introduced to the retort to advance the combustion zone through the retort.

It can be time consuming to establish a combustion zone in a retort. For example, a startup time as long as a week has been experienced with a retort in the south-/southwest portion of the Piceance Creek structural basin in Colorado. Such a long startup time results in consumption of large quantities of LPG, an expensive, premium fuel.

An in situ oil shale retort can have a substantial lateral extent. For example, it can be square with a lateral dimension of 100 feet or more. With such a large retort, a large number of burners and bore holes to various portions of the top of the retort and large quantities of fuel such as LPG can be required for establishing a combustion zone in the retort. Preparation of a large number of bore holes and use of a large number of burners and large quantities of LPG can contribute significantly to the cost of producing hydrocarbon products from oil shale.

A method for establishing a combustion zone in a retort as described in U.S. Pat. No. 3,952,801 can result in establishment of a combustion zone which is skewed and/or warped if only a few burners are used for establishing a combustion zone. Use of more than a few burners to avoid a skewed or warped combustion zone can significantly increase the cost of establishing a combustion zone in a retort and producing shale oil. It is desirable to maintain a combustion zone which is flat and uniformly transverse to the direction of its advancement to maximize yield of hydrocarbon products from the oil shale in an in situ oil shale retort. If the combustion zone is skewed relative to its direction of advancement, there is more tendency for oxygen present in the combustion zone to migrate into the retorting zone, thereby oxidizing hydrocarbon products produced in the retorting zone and reducing hydrocarbon yield. In addition, with a skewed and/or warped combustion zone, excessive cracking of hydrocarbon products produced in the retorting zone can result.

Around each ignition point of situs in the fragmented permeable mass, a combustion zone is formed which tends to progress downwardly and laterally in the fragmented permeable mass. The combustion zone advances downwardly through the fragmented mass primarily by gas flowing through the retort and advances laterally and radially in the fragmented mass primarily by conduction and radiation. Since heat transfer by conduction and radiation through a fragmented mass of formation particles is much slower than heat transfer by convection, a substantial amount of unretorted oil shale can be left in the "corners" or side edges adjacent the walls of a retort. This can significantly reduce the yield of hydrocarbons obtained from the retort.

Thus, it is desirable to provide a low cost and fast method for establishing a combustion zone an in situ oil shale retort where the combustion zone is flat and uniformly transverse to its direction of advancement and extends laterally to the walls of the retort.

SUMMARY OF THE INVENTION

The present invention is directed to a method having the above features. According to this invention, a void is excavated in a subterranean formation containing oil shale within the boundaries of an in situ oil shale retort to be formed in the subterranean formation. Combustible material is placed in the subterranean formation, such as in the void, adjacent an ignition situs. Formation is explosively expanded toward the void to form an in situ oil shale retort containing a fragmented permeable mass of formation particles containing oil shale, at least a portion of the fragmented mass adjacent an ignition situs containing such combustible material. Preferably the ignition situs and the portion of the fragmented mass containing such combustible material are at the top of the fragmented permeable mass. Such combustible material is ignited for establishing a combustion zone adjacent the ignition situs and for retorting oil shale in the in situ oil shale retort.

The combustible material can be coal or gelled shale oil. These combustible materials have desirable features such as a higher heat of combustion than the heat of combustion of the oil shale in the subterranean formation, lower ash content per unit volume than the ash content unit volume of the oil shale in the subterranean formation, and a lower spontaneous ignition temperature than the spontaneous ignition temperature of the oil shale in the subterranean formation. The combustible material can comprise oil shale having a higher kerogen content than the average kerogen content of the oil shale in the subterranean formation.

DRAWINGS

Figure 3:
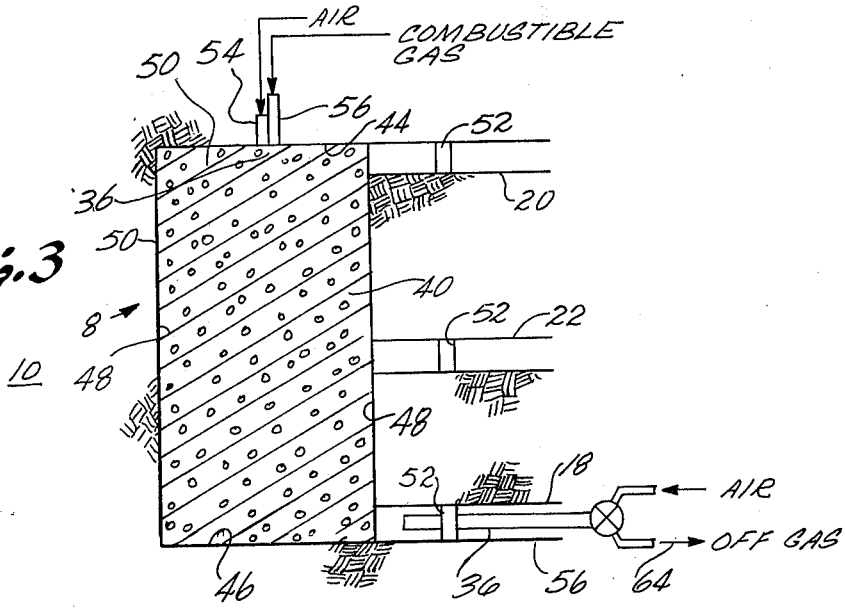
Figure 2:
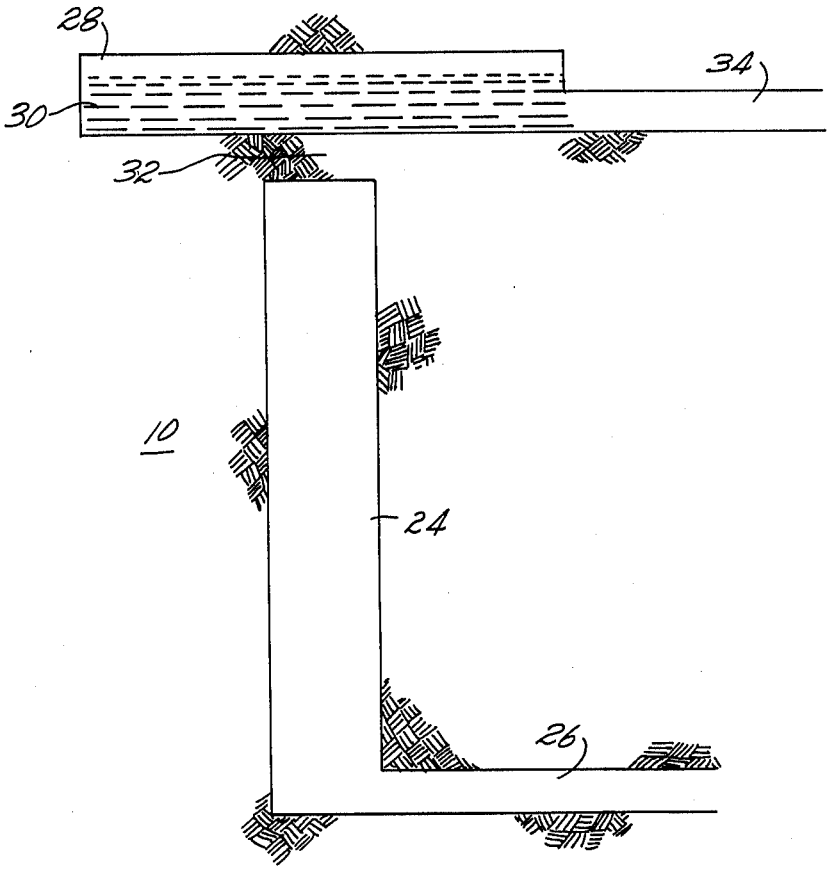

These and other features, aspects and advantages of the present invention will become more apparent when considered with respect to the following description, appended claims, and accompanying drawings where:

FIG. 1 shows a subterranean formation containing oil shale in an intermediate stage of preparation for in situ recovery of liquid and gaseous hydrocarbons;

FIG. 2 also shows a subterranean formation containing oil shale in an intermediate stage of preparation for in situ recovery of liquid and gaseous hydrocarbons; and FIG. 3 illustrates schematically an in situ oil shale retort useful in the practice of this invention.

DESCRIPTION

With reference to the Drawings, to prepare an in situ oil shale retort 42 in a subterranean formation 10 containing oil shale, formation from within the boundaries of an in situ oil shale retort being prepared is excavated or mined to form at least one void or chamber, thereby leaving a second portion of the formation within the boundaries of the in situ oil shale retort being prepared. A variety of mining schemes can be used for preparation of the retort 42. For example, with reference to FIG. 1, one or more horizontal voids can be excavated within the boundaries of the in situ oil shale retort being formed, as described in U.S. Pat. application Ser. No. 659,899, filed on Feb. 20, 1976, now U.S. Pat. No. 4,043,598, assigned to the assignee of this application, and incorporated herein by this reference. According to the method described in the U.S. Pat. No. 659,899 application, a first chamber or void 12 can be formed at the bottom boundary and a second chamber or void 14 can be formed at the top boundary of the in situ oil shale retort to be formed in the subterranean formation 10. An intermediate void 16 can be provided above the bottom void 12 and below the top void 14. The top void can extend substantially completely across the top boundary of the retort to be formed in the formation. Access to the formation for excavating the bottom 12, top 14, and intermediate 16 voids can be provided by a bottom access drift 18, a top access drift 20, and an intermediate access drift 22, respectively. As used herein, the term "drift" includes tunnels, adits, and the like.

An alternate mining scheme for preparation of a retort is described in U.S. Pat. application Ser. No. 603,704, filed on Aug. 11, 1975, now U.S. Pat. No. 4,043,595, assigned to the assignee of this invention, and incorporated herein by this reference. With reference to FIG. 2, according to Patent application Ser. No. 603,704, one or more columnar voids 24, each void having a vertically extending free face, can be excavated in the subterranean formation 10 containing oil shale. The columnar void can be cylindrical or can be a slot having one or more large, parallel, planar vertical free faces. An access drift 26 can be provided in the subterranean formation at the bottom boundary of an in situ oil shale retort to be formed in the formation for excavating the vertically extending void 24.

Another mining technique which can be used for preparation of a retort is described in the aforementioned U.S. Pat. No. 3,661,423. According to this method, an undercut or void is excavated to the length and width of the in situ oil shale retort being formed. A plurality of small support pillars are left in the undercut. The undercut can be excavated from an access drift which can be at the elevation of the bottom boundary of the retort being formed.

Only a portion of the formation within the boundaries of an in situ oil shale retort is excavated in the above-described mining schemes. For example, from about 5 to about 25% of the formation within the boundaries of a retort being formed can be excavated.

Combustible material is placed in the subterranean formation afer excavating the voids required for formation of an in situ oil shale retort. As shown in FIG. 2, when utilizing a mining scheme having a vertically extending void 24, a horizontally extending void or chamber 28 extending substantially completely across the top boundary of an in situ oil shale retort to be formed in the formation can also be provided in the subterranean formation. The purpose of the horizontally extending void 28 is to provide a location in the subterranean formation for placement of combustible material 30 at the top boundary of the in situ oil shale retort to be formed. Preferably unexcavated formation 32 is left between the horizontally extending void 28 and the vertically extending void 24 so combustible material placed in the horizontal void does not drop into the vertical void 24. Access to the formation for excavation of the horizontal void can be provided by an access drift 34.

After formation of one or more voids in the subterranean formation, a combustible material is placed in the subterranean formation in such a void adjacent an ignition situs.

Preferably the combustible material is a solid, i.e., a substance that does not flow perceptibly under moderate stress, so that combustible material placed at the top boundary of an in situ oil shale retort remains in place.

The combustible material can be a solid fuel such as coal, gelled shale oil, peat, high grade oil shale, and combinations thereof. By high grade oil shale there is meant oil shale having a higher kerogen content per unit volume than the average kerogen content per unit volume of the oil shale in the subterranean formation. Combustible material placed in the retort, including high grade oil shale, has a lower ash content per unit volume than the average ash content per unit volume of oil shale in the subterranean formation and has a higher heat of combustion than the average heat of combustion of oil shale in the subterranean formation. As used herein, heat of combustion refers to the amount of heat evolved by the combustion of one pound of the combustible material. With reference to oil shale, heat of combustion refers to the amount of heat evolved by one pound of oil shale, including non-combustible constituents of oil shale, and is not limited to just the kerogen contained in oil shale.

Preferably a combustible solid material has a particle size less than about one inch so a large surface area is available for ignition.

A low grade solid combustible material such as subbituminous coal, lignite coal, peat, or sawdust, which has limited or no economic value, can be used in the method of this invention.

Both solids and liquids can be used simultaneously as the combustible material. For example, an absorbent, solid combustible material such as peat can be placed in a void in the subterranean formation and then a liquid combustible material such as crude petroleum oil, shale oil, napalm, diesel oil, a self-igniting liquid such as linseed oil, or combinations thereof, can be added into the void to be absorbed therein by the solid material. Alternately, the solid material can be soaked in a liquid combustible material such as shale oil before it is placed in the subterranean formation. A liquid combustible material by itself is unsatisfactory because it tends to flow away from an ignition situs.

For a combustible material to be of value in establishing a combustion zone, it is preferred that the combustible material has a higher heat of combustion than the heat of combustion of oil shale in the subterranean formation and that the combustible material has a lower ash content per unit volume than the ash content per unit volume of oil shale in the subterranean formation.

Preferably combustible material is placed in the subterranean formation in a layer which extends substantially completely across the entire top boundary of the retort to be formed in the formation. This is done so a combustion zone extending across the entire top of the retort can be established in the retort. The upper drift 20 (FIG. 1), 34 (FIG. 2) can be used for access to place combustible material in the subterranean formation 10.

After excavating one or more voids in the subterranean formation 10 and placing combustible material in the subterranean formation, means for explosively expanding unfragmented formation such as columnar charges of explosive are provided in the subterranean formation. The remaining formation within the boundaries of an oil shale retort being formed is fragmented by explosive expansion toward such an excavated void to form a fragmented permeable mass 40 of formation particles containing oil shale.

With reference to FIG. 3, by such explosive expansion a retort 8 having top 44, bottom 46, and side 48 boundaries of unfragmented formation is formed in the subterranean formation. Such a retort 48 comprises a cavity 50 containing a fragmented permeable mass of formation particles containing oil shale 40. With reference to the horizontal mining scheme shown in FIG. 1, the fragmented mass 40 fills the lower void 12 and extends up into the upper void 14, and can substantially completely fill the upper void 14. With reference to the mining scheme shown in FIG. 2, the fragmented mass fills the vertical void 24 and extends up into the upper void 28, and can substantially completely fill the upper void 28. In preparing a retort using the mining scheme of FIG. 2, unexcavated formation 32 between the horizontal void 38 and the vertical void 24 is explosively expanded and fragmented. A top layer 50 of the fragment mass contains combustible material placed in the subterranean formation. Preferably the entire top layer of the fragmented mass, including fragmented mass adjacent the side boundaries of the cavity contain combustible material so a combustion zone can be established across the entire lateral extent of the retort.

In preparation for establishment of a combustion zone in the retort 42, a gas impervious barrier or stoppage such as a bulkhead 52 is provided in each access drift to the retort. This is done to prevent gas produced during establishment of a combustion zone and retorting operations from entering regions of the subterranean formation where retort preparation operations are occurring.

A combustion zone can be established in the retort 42 by a variety of techniques such as the technique described in the aforementioned U.S. Pat. No. 3,952,801. To establish the combustion zone, air or other oxygen containing gas can be introduced to an ignition situs 36 at the top of the retort through a conduit or borehole 54. Simultaneously a combustible gas such as LPG is introduced to the ignition situs 36 through a conduit or borehole 56. The gas and air mixture at the ignition situs can be ignited by means such as an electrical spark, and the resulting flame is used to heat combustible material in the top portion of the fragmented permeable mass to the ignition temperature of the combustible material. Once ignition is started, the flame is turned off by stopping the flow of combustible gas, and only air or other oxygen containing gas is introduced through the conduit 54 to propagate the combustion zone laterally and downwardly through the fragmented permeable mass.

As described in co-pending application Ser. No. 772,760, filed on Feb. 28, 1977, entitled "Method For Assuring Uniform Combustion In An In Situ Oil Shale Retort", now abandoned, introduction of oxygen containing gas into the retort can be reduced to a rate such that substantially no heat is transferred by gas flow from the combustion zone for permitting lateral heat transfer without significant downward advancement of the combustion zone. This can be effected by completely shutting off the flow of oxygen containing gas into the retort. Using this technique, the combustion zone can extend laterally to the side walls 48 of the retort without appreciable downward movement. The rate of lateral propagation of the combustion zone can be increased and the rate of downward propagation of the combustion zone can be reduced by introducing an oxygen containing gas such as air to the bottom of the retort. Such gas can be introduced through a conduit 56 in the bottom access drift 18, the conduit extending through the bulkhead 52 in the bottom access drift. Such introduced gas passes upwardly through the retort 42 into the combustion zone. Gas can be withdrawn from the retort through either the conduit 54 used for introducing air downwardly into the retort or the conduit 56 used for introducing combustible gas downwardly into the retort when igniting combustible material in the retort.

After the combustion zone has spread across the top of the fragmented permeable mass to the side boundaries of the cavity 50, introduction of oxygen containing gas such as air to the bottom of the retort can be stopped and introduction of air as a gaseous combustion zone feed containing a source of oxygen into the top of the in situ oil shale retort can be restarted. By introduction of combustion zone feed into the top of the retort, the combustion zone is advanced downwardly through the retort with resultant retorting of oil shale in a retorting zone on the advancing side of the retort. An off gas 64 containing combustion gas generated in the combustion zone, gaseous products produced in the retorting zone, gas from carbonate decomposition, and any gaseous portion of the combustion zone feed introduced to the top of the retort that does not take part in the combustion process is withdrawn from the retort via the conduit 56 in the bottom access drift 18.

The method of this invention has significant advantages compared to prior art methods for establishing a combustion zone in a retort. For example, it is estimated that using an anthracite coal as the combustible material, a combustion zone can be established across the entire lateral extent of an in situ oil shale retort in as few as three hours. This is a significant improvement compared to one or more days required with prior art methods. With such a quick startup time, usable product can be obtained from the retort faster than with prior art methods. In addition, because of the quick startup, less energy is expended for driving blowers for introducing combustible gas and air into the retort during the nonproductive startup operation than with prior art methods.

Another advantage of the method of this invention is that a combustion zone extending across the entire lateral extent of the retort can be established, thereby avoiding bypassing pockets of oil shale in the corners of the retort. This results in enhanced yield of hydrocarbons from the fragmented permeable mass in the retort, and production of hydrocarbons from retorting oil shale in the walls of unfragmented formation at the corners of the retort.

Using the method of this invention, fewer burners and ignition sites can be required to insure that a combustion zone propagates laterally to the side boundaries of the retort because the combustible material is more easily ignited than oil shale. Thus, substantial savings in capital and operating costs for burners and substantial savings in costs incurred in providing boreholes and conduits for introduction of combustible gas and burners to the top of the fragmented permeable mass can be achieved.

Another advantage of this invention is that a combustion zone which is flat and uniformly transverse to its direction of advancement can be established in the retort. Thus oxidation and excessive cracking of hydrocarbons produced in the retorting zone which can occur with a skewed and/or warped combustion zone are avoided.

A further advantage of a method according to this invention is that consumption of an expensive fuel such as liquefied petroleum gas is reduced. Rather than using LPG, a low cost fuel such as low grade coal, high grade oil shale, or peat can be used for supplying the heat required for igniting oil shale in an in situ oil shale retort.

Another advantage of a method according to this invention is that it can be used with a retort which is substantially completely filled with a fragmented permeable mass of formation particles containing oil shale, and is not dependent upon the presence of a void at the top of the fragmented mass. This is because combustible material is placed within the boundaries of the retort to be formed before explosive expansion of the formation. Thus, there is no need for a void at the top of the fragmented mass after explosive expansion of formation for placement of combustible material.

It is important that a method according to this invention for establishing a combustion zone in a retort can be used with a retort which is substantially completely filled with a fragmented permeable mass of formation particles containing oil shale because there are many advantages to a filled retort. Among these is that the mass of particles in the retort can support overlying formation. This allows a higher percentage of the formation to be fragmented with enhanced recovery of hydrocarbon products because less formation needs to be left unfragmented as supporting pillars for overburden than if the retort were only partially filled with a fragmented mass of formation particles. Another advantage of having a filled retort is that sloughing of overburden into a void at the top of the fragmented permeable mass during ignition of the fragmented mass with resultant loss of support for the upper portion of the overburden cannot occur.

A further advantage of a filled retort is that it is easier to ignite a completely filled retort than a partially filled retort. This is because sloughing of overburden onto the top of the fragmented mass in a retort during establishment of a combustion zone can decrease the temperature of oil shale already heated to above its ignition temperature to a temperature below the ignition temperature of the oil shale.

Another advantage of a filled retort is higher recovery of hydrocarbon products can be obtained than with a retort having the same volume, but only partially filled with oil shale, because more oil shale is available for retorting.

Advantages of the present invention are demonstrated by this Control and Example.

CONTROL

A retort containing a fragmented permeable mass of formation particles containing oil shale is formed in the south/southwest portion of the Piceance Creek structural basin in Colorado. The retort is square in cross-section having dimensions of about 35 feet by about 35 feet. The retort is about 113 feet high. Oil shale at the top of the fragmented permeable mass has a Fischer Assay of about 10 to about 15 gallons per ton. To establish a combustion zone at the top of the retort, 16 SCFM (standard cubic feet per minute) of LPG having a heating value of 2300 BTU/SCF (British Thermal Units per standard cubic foot) and sufficient oxygen to completely oxidize the LPG are introduced to the top of the retort and the LPG is ignited. Establishment of a combustion zone at the top of the retort requires about 24 hours.

EXAMPLE

A void is excavated substantially completely across the top boundary of an in situ oil shale retort to be formed in the south/southwest portion of the Piceance Creek structure basin in Colorado. A layer of anthracite coal is placed substantially completely across the floor of the void. Remaining formation within the boundaries of the in situ shale retort to be formed is explosively expanded toward the void to form a retort having the same dimensions as the retort of the Control. Oil shale in the top of the fragmented permeable mass in the retort has a Fischer Assay of about 10 to 15 gallons per ton. The entire top portion of the fragmented permeable mass in the retort contains anthracite coal. Establishment of a combustion zone across the top of the fragmented permeable mass is effected in about ½ hour.

Although this invention has been described in considerable detail with reference to certain versions thereof, other versions are within the scope of this invention. For example, for a retort having a substantial cross-sectional area, it can be preferable to have a plurality of ignition sites at the top of the fragmented permeable mass so ignition is obtained at several points and so distance for lateral propagation of the combustion zone in the retort is minimized. In addition, although FIG. 3 shows a retort where a combustion zone is established at the top of the retort, this invention is also useful for retorts where the combustion zone is established at the bottom of the retort and the combustion and retorting zones are advanced upwardly through the retort.

Because of variations such as these, the spirit and scope of the appended claims should not necessarily be limited to the description of the preferred versions contained herein.

What is claimed is:

1. A method for retorting oil shale in an in situ oil shale retort in a subterranean formation containing oil shale, such a retort containing a fragmented permeable mass of formation particles containing oil shale, comprising the steps of:
   - excavating a void in the subterranean formation within the boundaries of an in situ oil shale retort to be formed in the subterranean formation;
   - placing combustible material in the void in the subterranean formation, the combustible material being placed adjacent an ignition situs;
   - explosively expanding formation toward the void to form an in situ oil shale retort containing a fragmented permeable mass of formation particles containing oil shale, at least a portion of the fragmented mass adjacent an ignition situs containing such combustible material; and
   - igniting such combustible material for establishing a combustion zone adjacent the ignition situs and retorting oil shale in the in situ oil shale retort.

2. The method of claim 1 in which the combustible material has a higher heat of combustion than the heat of combustion of the oil shale in the subterranean formation.

3. The method of claim 1 in which the combustible material has a lower ash content per unit volume than the ash content per unit volume of the oil shale in the subterranean formation.

4. The method of claim 1 in which the combustible material has a lower spontaneous ignition temperature than the spontaneous ignition temperature of the oil shale in the subterranean formation.

5. The method of claim 1 in which the combustible material comprises oil shale having a higher kerogen content per unit volume than the average kerogen content per unit volume of the oil shale in the subterranean formation.

6. The method of claim 1 in which the combustible material comprises coal.

7. The method of claim 1 in which the combustible material has a higher heat of combustion than the average heat of combustion of oil shale in the subterranean formation.

8. The method of claim 1 in which the combustible material has a lower ash content per unit volume than the average ash content per unit volume of oil shale in the subterranean formation.

9. A subterranean formation containing oil shale in an intermediate stage of preparation for in situ recovery of liquid and gaseous hydrocarbons from the oil shale comprising:
   - a chamber in the subterranean formation located at the top boundary of an in situ oil shale retort to be formed in the subterranean formation;
   - a zone of unfragmented formation containing oil shale below the chamber;
   - fragmented material comprising combustible material in the chamber adjacent an ignition situs; and
   - means for explosively expanding unfragmented formation adjacent the chamber toward the chamber to form an in situ oil shale retort containing a fragmented permeable mass of formation particles containing oil shale wherein at least a portion of the fragmented mass adjacent such an ignition situs contains such combustible material.

10. A method for retorting oil shale in an in situ oil shale retort in a subterranean formation containing oil shale, such a retort having top, bottom, and side boundaries and containing a fragmented permeable mass of formation particles containing oil shale, comprising the steps of:

excavating a void in the subterranean formation at the top boundary of an in situ oil shale retort to be formed in the subterranean formation;

placing combustible material in the void adjacent an ignition situs;

explosively expanding formation toward the void to form an in situ oil shale retort containing a fragmented permeable mass of formation particles containing oil shale, the top layer of the fragmented mass adjacent an ignition situs containing such combustible material; and igniting such combustible material for establishing a combustion zone in the top layer adjacent the ignition situs and for retorting oil shale in the in situ oil shale retort.

11. The method of claim 10 in which the combustible material has a higher heat of combustion than the heat of combustion of the oil shale in the subterranean formation.

12. The method of claim 10 in which the combustible material has a lower ash content per unit volume than the ash content per unit volume of the oil shale in the subterranean formation.

13. The method of claim 10 in which the combustible material has a lower spontaneous ignition temperature than the spontaneous ignition temperature of the oil shale in the subterranean formation.

14. The method of claim 10 in which the combustible material comprises oil shale having a higher kerogen content than the average kerogen content of the oil shale in the subterranean formation.

15. The method of claim 10 in which the combustible material comprises coal.

16. The method of claim 10 in which the combustible material has a higher heat of combustion than the average heat of combustion of oil shale in the subterranean formation.

17. The method of claim 10 in which the combustible material has a lower ash content per unit volume than the average ash content per unit volume of oil shale in the subterranean formation.

18. A method for establishing a combustion zone in an in situ oil shale retort in a subterranean formation containing oil shale, such a retort comprising a cavity having top, bottom, and side boundaries and substantially completely filled with a fragmented permeable mass of formation particles containing oil shale, comprising the steps of:

excavating a void in a subterranean formation containing oil shale substantially completely across the top boundary of an in situ oil shale retort to be formed in the subterranean formation;

placing a layer of combustible material in the void adjacent an ignition situs, the combustible material having a higher heat of combustion than the heat of combustion of oil shale in the subterranean formation;

explosively expanding formation toward the void to form an in situ oil shale retort comprising a cavity having top, bottom, and side boundaries and substantially completely filled with a fragmented permeable mass of formation particles containing oil shale, the top layer of the fragmented mass adjacent an ignition situs containing such combustible material; and igniting such combustible material for establishing a combustion zone in the top layer adjacent the ignition situs.

19. The method of claim 18 in which the entire top layer of the fragmented mass contains such combustible material.

20. The method of claim 18 in which the top layer of the fragmented permeable mass adjacent the side boundaries of the cavity of the retort comprises such combustible material.

21. A method for retorting oil shale in an in situ oil shale retort in a subterranean formation containing oil shale, such a retort comprising a cavity having top, bottom, and side boundaries and containing a fragmented permeable mass of formation particles containing oil shale, comprising the steps of:

forming a first void in a subterranean formation containing oil shale at the bottom boundary of an in situ oil shale retort to be formed in the subterranean formation;

forming a second void in the subterranean formation above the first void at the top boundary of the in situ oil shale retort to be formed in the subterranean formation;

placing a layer of combustible material in the upper void, the combustible material having a higher heat of combustion than the heat of combustion of oil shale in the subterranean formation;

explosively expanding formation remaining in the subterranean formation between the two voids to form an in situ oil shale retort comprising a cavity containing a fragmented permeable mass of formation particles containing oil shale and having top, bottom, and side boundaries, the fragmented mass filling the lower void and extending up into the upper void, a top layer of the fragmented mass containing such combustible material;

introducing air downwardly into the top of the in situ oil shale retort;

igniting combustible material in the top layer of the fragmented permeable mass with a flame to establish a combustion zone in the fragmented permeable mass;

turning off the flame and interrupting the downward introduction of air into the top of the retort after ignition of combustible material in the top of the fragmented permeable mass; and restarting the introduction of air into the top of the in situ oil shale retort after the combustion zone has spread across the top of the fragmented permeable mass to the side boundaries of the cavity.

22. The method of claim 21 in which the combustible material comprises coal.

23. A method for retorting oil shale in an in situ oil shale retort in a subterranean formation containing oil shale, such a retort containing a fragmented permeable mass of formation particles containing oil shale and having top, bottom, and side boundaries, comprising the steps of:

forming a vertically extending void in a subterranean formation containing oil shale within the boundaries of an in situ oil shale retort to be formed in the subterranean formation;

explosively expanding formation remaining in the subterranean formation toward the void to form an in situ oil shale retort containing a fragmented permeable mass of formation particle containing oil shale;

forming a layer of combustible particles derived from coal adjacent the top of the fragmented permeable mass;

introducing air onto the top of the fragmented permeable mass;

igniting combustible particles adjacent the top of the fragmented permeable mass for heating and igniting adjacent oil shale particles; and after ignition temporarily interrupting introduction of air onto the top of the fragmented mass until the combustible particles adjacent the top of the fragmented permeable mass are heated to their ignition temperature.

24. A method for retorting oil shale in an in situ oil shale retort in a subterranean formation containing oil shale, such a retort containing a fragmented permeable mass of formation particles containing oil shale, comprising the steps of:

forming a first void in a subterranean formation containing oil shale at the bottom boundary of an in situ oil shale retort to be formed in the subterranean formation;

forming a second void in the subterranean formation above the first void at the top boundary of the in situ oil shale retort to be formed in the subterranean formation;

placing a layer of combustible material in the upper void, the combustible material having a higher heat of combustion than the heat of combustion of oil shale in the subterranean formation;

explosively expanding formation remaining in the subterranean formation between the two voids to form an in situ oil shale retort comprising a cavity containing a fragmented permeable mass of formation particles containing oil shale, the fragmented mass filling the lower void and extending up into the upper void, a top portion of the fragmented permeable mass containing said placed combustible material; and igniting combustible material in the top portion of the fragmented permeable mass containing said placed combustible material to form a combustion zone in the fragmented permeable mass.

25. The method of claim 24 in which the combustible material comprises coal.

26. A method for retorting oil shale in an in situ oil shale retort in a subterranean formation containing oil shale, such a retort containing a fragmented permeable mass of formation particles containing oil shale, comprising the steps of:

forming a vertically extending void in a subterranean formation containing oil shale within the boundaries of an in situ oil shale retort to be formed in the subterranean formation;

forming a layer of combustible particles derived from coal adjacent the top of the fragmented permeable mass, including the step of mixing the combustible particles with the top layer of the fragmented mass by placing the combustible particles on top of oil shale formation and explosively expanding such formation to fragment such formation into a fragmented permeable mass of formation particles containing oil shale; and igniting the combustible particles mixed with the top layer of the fragmented permeable mass for heating and igniting formation particles in the fragmented mass adjacent to the combustible particles and containing oil shale.

27. The method of claim 26 in which the combustible particles comprise coal.

28. The formation of claim 9 in which the combustible material has a higher heat of combustion than the heat of combustion of the oil shale in the subterranean formation.

29. The formation of claim 9 in which the combustible material has a lower ash content per unit volume than the ash content per unit volume of the oil shale in the subterranean formation.

30. The formation of claim 9 in which the combustible material has a lower spontaneous ignition temperature than the spontaneous ignition temperature of the oil shale in the subterranean formation.

31. The formation of claim 9 in which the combustible material comprises oil shale having a higher kerogen content per unit volume than the average kerogen content per unit volume of the oil shale in the subterranean formation.

32. The formation of claim 9 in which the combustible material comprises coal.

33. The formation of claim 9 in which the combustible material has a higher heat of combustion than the average heat of combustion of oil shale in the subterranean formation.

34. The formation of claim 9 in which the combustible material has a lower ash content per unit volume than the average ash content per unit volume of oil shale in the subterranean formation.

35. A subterranean formation containing oil shale in an intermediate stage of preparation for in situ recovery of liquid and gaseous hydrocarbons from the oil shale comprising:

a chamber in the subterranean formation located at the top boundary of an in situ oil shale retort to be formed in the subterranean formation;

a zone of unfragmented formation containing oil shale below the chamber;

a top layer of fragmented material comprising combustible material in the chamber adjacent an ignition situs; and means for explosively expanding unfragmented formation adjacent the chamber toward the chamber to form an in situ oil shale retort containing a fragmented permeable mass of formation particles containing oil shale wherein at least a portion of the top layer of the fragmented mass adjacent such an ignition situs contains such combustible material.

36. The formation of claim 35 in which the combustible material has a higher heat of combustion than the heat of combustion of the oil shale in the subterranean formation.

37. The formation of claim 35 in which the combustible material has a lower ash content per unit volume than the ash content per unit volume of the oil shale in the subterranean formation.

38. The formation of claim 35 in which the combustible material has a lower spontaneous ignition temperature than the spontaneous ignition temperature of the oil shale in the subterranean formation.

39. The formation of claim 35 in which the combustible material comprises coal.

* * * * *